US006585510B2

(12) United States Patent
Papai

(10) Patent No.: US 6,585,510 B2
(45) **Date of Patent: *Jul. 1, 2003**

(54) VENTING PLATE FOR A CONTAINERIZED CANDLE

(75) Inventor: Tod A. Papai, LaPorte, IN (US)

(73) Assignee: Smith Mountain Properties, LLC., Forest, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/040,121

(22) Filed: Jan. 4, 2002

(65) Prior Publication Data

US 2002/0058223 A1 May 16, 2002

(51) Int. Cl.[7] ..... F21L 19/00; F21V 37/02; F21V 35/00

(52) U.S. Cl. ..... 431/291; 431/289; 362/163; 362/180

(58) Field of Search ..... 431/288, 289, 431/290, 320, 321, 298, 300, 310, 291; 362/161, 163, 171, 173, 180, 182, 266, 312, 313; 126/43, 44, 45

(56) References Cited

U.S. PATENT DOCUMENTS

| | | | | | |
|---|---|---|---|---|---|
| 8,732 | A | * | 2/1852 | Blaisdell et al. | 126/152 R |
| 142,432 | A | * | 9/1873 | Blaisdell et al. | 362/171 |
| 179,548 | A | * | 7/1876 | Graves | 362/171 |
| 205,648 | A | * | 7/1878 | Irwin | 417/151 |
| 212,603 | A | * | 2/1879 | Irwin | 362/171 |
| 214,238 | A | * | 4/1879 | Butler | 362/312 |
| 222,663 | A | * | 12/1879 | Cash et al. | 362/171 |
| 439,672 | A | * | 11/1890 | Miller | |
| 492,953 | A | * | 3/1893 | Boesch | |
| 492,954 | A | * | 3/1893 | Boesch | 362/180 |
| 493,495 | A | * | 3/1893 | Funck | 362/180 |
| 556,286 | A | * | 3/1896 | Schlicht | |
| 564,882 | A | * | 7/1896 | Hamm | 362/171 |
| 595,191 | A | * | 12/1897 | Miller et al. | 362/180 |
| 1,039,123 | A | * | 9/1912 | Hamm | |
| 1,097,464 | A | * | 5/1914 | Prahm | 362/182 |
| 1,104,383 | A | * | 7/1914 | Potter | |
| 1,162,682 | A | * | 11/1915 | Cherry | 422/126 |
| 1,250,102 | A | * | 12/1917 | Doughman et al. | |
| 1,278,061 | A | * | 9/1918 | Townsley | |
| 1,446,353 | A | * | 3/1923 | Slocum | |
| 1,540,015 | A | * | 6/1925 | Karlson | |
| 1,568,465 | A | * | 1/1926 | Olsen | |
| 1,705,877 | A | * | 5/1929 | Ramsey | |
| 1,915,622 | A | * | 6/1933 | Sevcik | |
| 2,080,251 | A | * | 5/1937 | Buskard | |
| 4,380,992 | A | * | 4/1983 | Spring | |
| 4,734,833 | A | * | 3/1988 | Schneeberger | |
| 4,926,298 | A | * | 5/1990 | Zimmerman | |
| 6,061,950 | A | * | 5/2000 | Carey et al. | |
| 6,231,336 | B1 | * | 5/2001 | Chen | |
| 6,382,962 | B1 | * | 5/2002 | Papai | |

FOREIGN PATENT DOCUMENTS

| | | | | |
|---|---|---|---|---|
| DE | 26 18 394 | * | 1/1978 | 431/291 |
| DE | 2925617 | * | 1/1981 | 431/298 |
| JP | 56-160509 | * | 10/1981 | 431/291 |

* cited by examiner

*Primary Examiner*—Carl D. Price
(74) *Attorney, Agent, or Firm*—R. Tracy Crump

(57) ABSTRACT

A venting plate that can be used with any containerized candle regardless of shape, wick configuration or dimension is disclosed. The venting cover stabilizes the combustion flame and improves the efficiency of the combustion of containerized candles, thereby reducing candle smoke. The venting plate is shaped to conform to the shape of the mouth of the particular containerized candle. The venting plate has a central exhaust vent and includes a peripheral outer flange, an inner baffle and a plurality of mounting bosses or feet. The venting plate is supported atop the mouth of the containerized candle by the mounting feet, which space the venting plate above the brim of the candle to form an annular inlet vent. The baffle follows the contour and shape of the outer flange and extends downward into the mouth of the candle when seated atop a candle. The baffle directs inlet air flow into the interior of the candle through the inlet vents downward along the sidewalls of the vessel and separates the downward inlet air flow from the upward exhaust air flow.

4 Claims, 6 Drawing Sheets

VENTING PLATE FOR A CONTAINERIZED CANDLE

This invention relates to a venting plate for containerized candles, which improves the candle's combustion and eliminates candle smoke.

BACKGROUND OF THE INVENTION

Containerized candles have been well known for hundreds of years. One drawback of containerized candles is the inefficiency of their combustion. If sufficient ambient air is not drawn to the base of the flame to oxidize the carbon particles in later stages of combustion, the flame will be smoky, and the exhaust will contain dark carbon residue, smoke. Consequently, providing a sufficient air flow is critical for a clean or smokeless combustion. The container limits and obstructs the air flow to the flame, which is needed for the combustion process. Ambient air must simultaneously be drawn downward into the container while hot exhaust vents out of the container. Hot exhaust from the flame rises upward in a convection flow, which creates a negative pressure to draw cool ambient air into the interior toward the base of the flame. Passing through the mouth of the container, the proximity of the opposing exhaust and intake air flows create turbulence within the container interior. The turbulence within the container increases proportionately to proximity between the exhaust and intake air flows, as well as, the temperature and velocity differentials of the airflows. The turbulent airflow within the container restricts and retards flow of the ambient air to the base of the flame. Consequently, the combustion in containerized candles often produces smoke. Turbulence within the container also destabilizes the flame, and can even extinguish it. The instability of the flame is evidenced by the flicker of the flame, which is common in containerized candles.

U.S. patent application Ser. No. 09/925,893 filed Aug. 9, 2001 describes a venting plate that is used with apothecary jar candles to improve the efficiency of the combustion. This venting plate has a central exhaust vent opening and a plurality of peripheral inlet vent openings which are situated to facilitate concentric laminar air flows within the container by separation of the cool inlet air from the hot exhaust air. While the teachings of U.S. patent application Ser. No. 09/925,893 are incorporated herein by reference, the venting plate of this patent is limited to cylindrical apothecary jar candles of certain dimensions and does not function optimally with different shaped vessels or large jar candles with multiple wicks. In addition, this venting plate also has some esthetic limitations. Because this venting plate has multiple openings for both the inlet and exhaust vents, the top surface venting plates cannot be adorned with three dimensional figurines or ornamentation without possibly affecting the air flows into and out of the candle. Consequently, this venting plate is limited esthetically to mere surface ornamentation. In addition, the multiple openings reduce the amount of surface area available for ornamentation.

SUMMARY OF INVENTION

The venting plate of this invention can be adapted for use with any containerized candle, regardless of shape, wick configuration or dimension. The venting plate stablizes the candle flame and improves the efficiency of the combustion in containerized candles thereby improving brightness and reducing candle smoke.

The venting plate is body shaped to cover the mouth of the containerized candle and has a body with generally flat upper and lower surfaces and exhaust vents. The plate body also includes a peripheral outer flange, an inner baffle and a plurality of mounting bosses or feet. The venting plate is supported atop the mouth of the containerized candle by the mounting bosses or feet. The mounting feet extend radially between the outer flange and the baffle and have an inclined lower face, which acts as a mechanism for self centering the venting plate atop the containerized candle. The mounting feet space the venting plate above the brim of the vessel to create an annular inlet vent into the candle interior. The baffle is a vertical skirt, which extends downward from the bottom surface of the venting plate between the outer flange and the exhaust vent. The baffle extends downward into the mouth of the vessel around the exhaust vent and follows the inner contour and shape of the brim of the containerized candle.

In use, inlet air is drawn through the annular inlet vent formed by the mounting feet between the bottom surface of the venting plate and the vessel brim and the outer flange and the baffle. The baffle directs inlet air flow downward into the interior of the candle through the inlet vents downward along the sidewalls of the vessel and separates the downward inlet air flow from the upward exhaust air flow. The separation of the opposing air flows (inlet and exhaust) reduces turbulence within the interior of the vessel and stabilizes the flame, which leads to a cleaner combustion process and reduced carbon residue (smoke) in the exhaust.

The venting plate of this invention is shaped to conform to the shape of the mouth of the particular containerized candle. The venting plate of this invention is illustrated in three separate embodiments of differing shapes, circular, oval and rectangular (square) although any shape and configuration may be incorporated without deviating from the basic teachings of the invention. The venting plate may also have multiple exhaust vents to accommodate containerized candles with multiple wicks. Another embodiment of the venting plate of this invention incorporates an annular chimney around the exhaust vent to prevent damage to ornamentation mounted to the upper surface of the venting plate. The various embodiments are illustrated simply to demonstrate the range and scope of the teaching of this invention.

Accordingly, an advantage of this invention is that the venting plate can be adapted for use with any containerized candle regardless of shape, wick configuration or dimensions.

Another advantage is that the venting plate includes an internal baffle for directing inlet air flow downward along the sidewalls of a containerized candle.

Another advantage is that the venting plate eliminates the need for peripheral inlet vent openings in the venting plate.

Another advantage is that the venting plate is supported atop a containerized candle by a plurality of mounting bosses, which space the plate above the brim of the candle to form an annular inlet vent.

Another advantage is that the venting plate can be adorned with three dimensional figurines and ornamentation, as well as, surface decorations without affecting the operation of the venting plate.

Another advantage is that the venting plate can incorporate a chimney to provide a thermal shield for protecting ornamentation mounted to the surface of the venting plate.

Another advantage is that the venting plate stabilizes the combustion flame and improves the efficiency of the combustion of conventional containerized candles, thereby reducing the smoke produced in the combustion process of containerized candles.

Another advantage is that the venting cover reduces turbulence in containerized candles by separating concentric laminar air flow within the candle container, which enables sufficient ambient air flow directly to the base of the flame.

Another advantage is that the apparatus improves the efficiency of the containerized candle without detracting from the decorative appearance of the candle.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to explain the invention so that others skilled in the art might utilize its teachings.

Four embodiments of the venting plate of this invention are illustrated in the figures and described below. The venting plate of this invention is intended to be adapted for use with any containerized candle regardless of shape, wick configuration or dimension. To this end, several different embodiments of the venting plate are illustrated, but the scope of the teaching of this invention is not limited to any such embodiment or their uses with any containerized candle of any particular shape, wick configuration or dimension. The first two embodiments (FIGS. 1–7) are intended for use with cylindrical apothecary jar containers. The third and fourth embodiments (FIGS. 8–13) are intended for uses with oval and rectangular shaped containerized candles, respectively. Generally, different embodiment of the venting plates differ only in their basic shape, which is selected to accommodate the shape and wick configuration of the containerized candle on which it is used.

Figure 11:
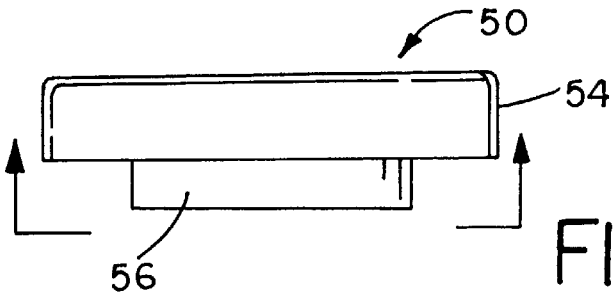
FIG. 11 is a side elevation view of the fourth embodiment (square) of the venting plate of this invention.
Figure 12:
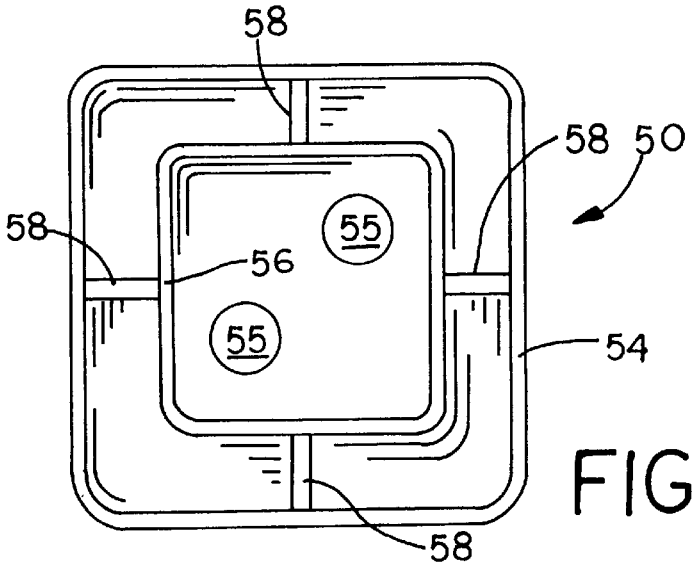
FIG. 12 is a bottom plan view of the fourth embodiment (square) of the venting plate of this invention.
Figure 13:
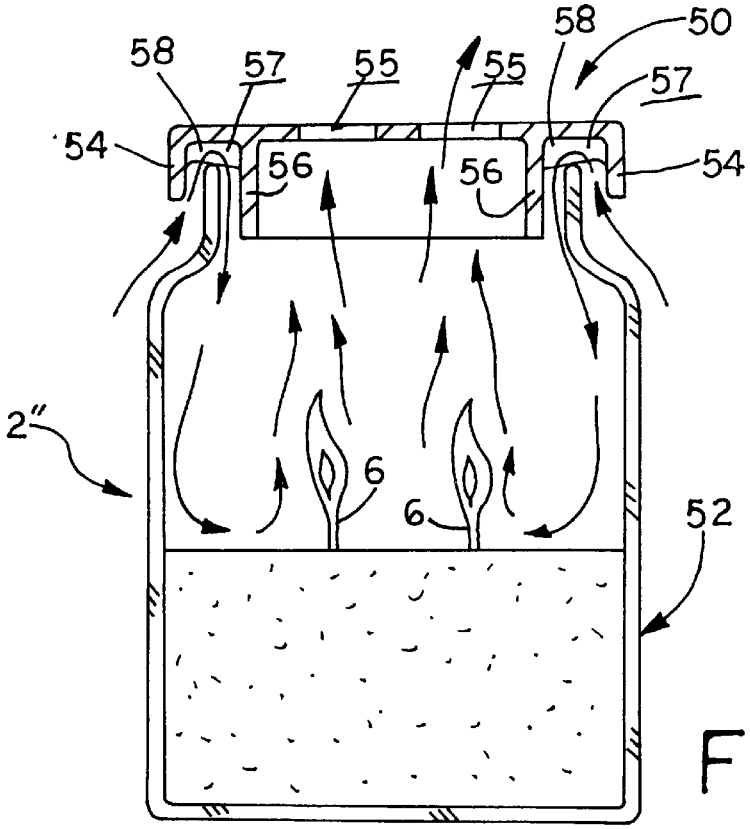
FIG. 13 is a side sectional view of a fourth embodiment (square) of the venting plate of this invention seated atop a square shaped containerized candle.

The containerized candles illustrated for each embodiment of the venting plates of this invention have the same basic construction. Each candle 2 (FIGS. 1–7), 2' (FIGS. 8–10) and 2" (FIGS. 11–13) includes a quantity of wax 4, and one or more cloth or porous wicks 6 contained inside a transparent or translucent glass jar or vessel. Three different shapes of vessel are illustrated in the figures: a cylindrical apothecary jar 10 (FIGS. 1–7), an oval jar 42 (FIGS. 8–10) and a rectangular jar 52 (FIGS. 11–13). Each vessel 10, 42 and 52 includes sidewalls 12 that terminate in a brim 14 forming an open mouth 15. While only three shapes of vessels are illustrated and described, the teaching of this invention may be readily applied to containerized candles of various shapes and dimensions without deviating from the scope of the invention. The size of the vessel or jar and the dimensions of its mouth may vary, as well as, its shape within the scope of this invention.

Wax 4 is employed in candle 2 as a fuel source and may take any natural unctuous, viscous or solid heat sensitive compound consisting essentially of high molecular weight hydrocarbons or esters of fatty acids. Candle wax 4 fills the bottom portion of vessel 10 which defines an open upper candle interior 17 within the vessel. One or more wicks 6 are seated within the solid wax. When candle 2 is burning, the heat from flame 8 creates a thin layer of melted candle wax across the top of the solid candle wax, which is drawn up the wicks 6 to feed the flame.

Each venting plate of this invention may be constructed from a material, which has thermal insulating properties, such as ceramic, glass, or a heat resistant plastic. Ideally, these materials, glass, ceramic and plastics are easily formed and molded. Although, glass, ceramic and plastics are highly desirable construction materials, the plates may also be constructed from metals, and other suitable materials without deviating from the principal teachings of this invention. The thermal conductive properties of metals simply require the appropriate user caution when handling the hot plates after use.

First Embodiment

Figure 1:
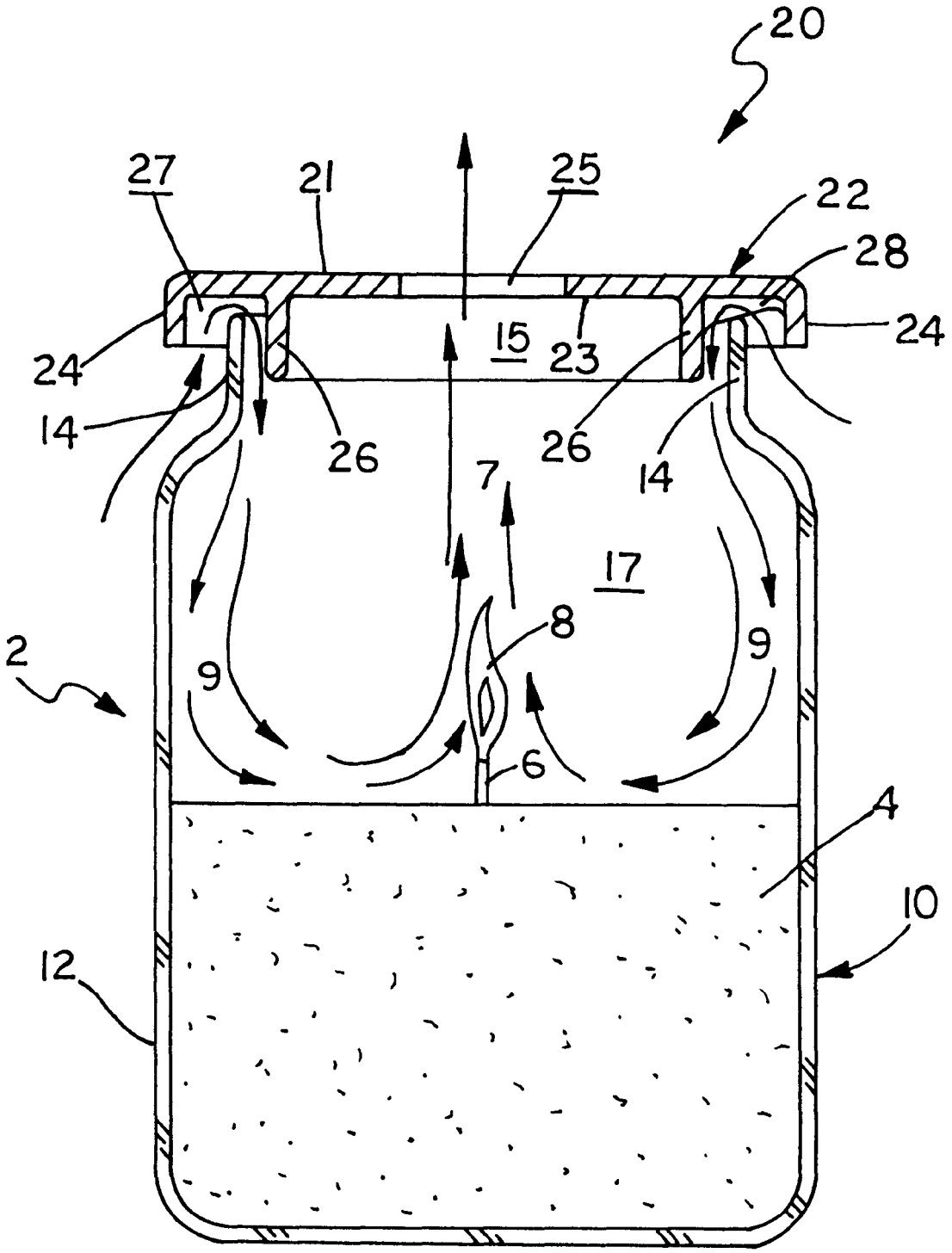
FIG. 1 is a side sectional view of a first embodiment (circular) of the venting plate of this invention seated atop a cylindrical containerized candle.
Figure 3:
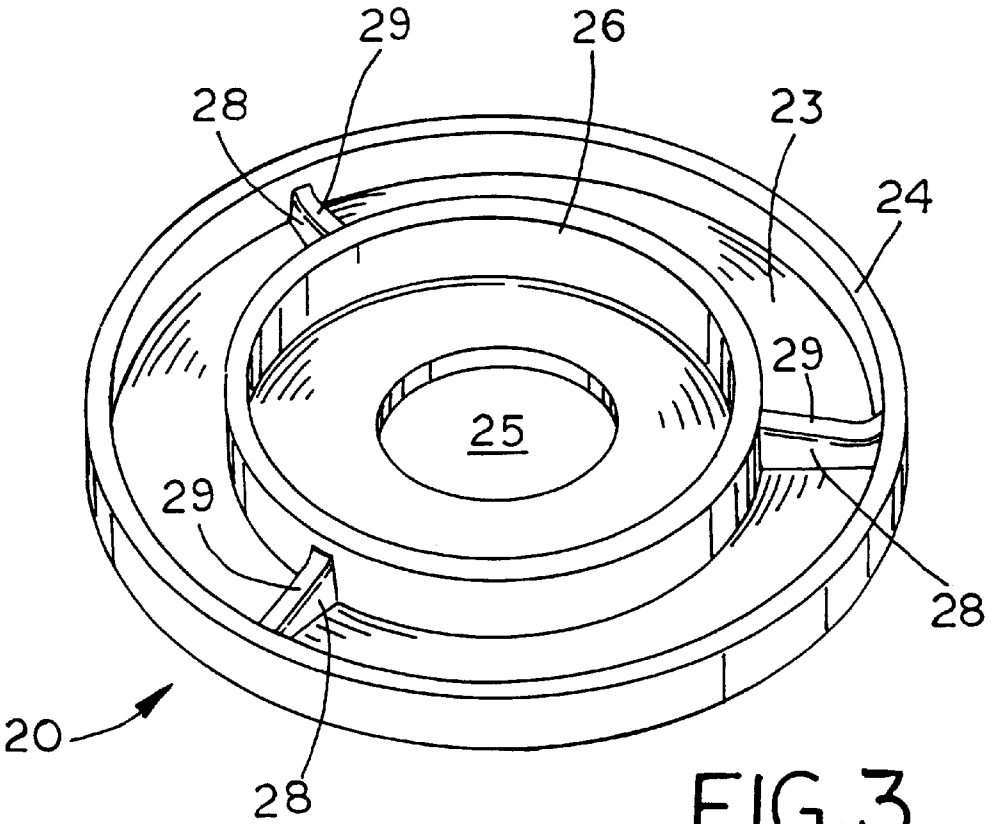
FIG. 3 is a bottom perspective view of the first embodiment (circular) of the venting plate of this invention.
Figure 2:
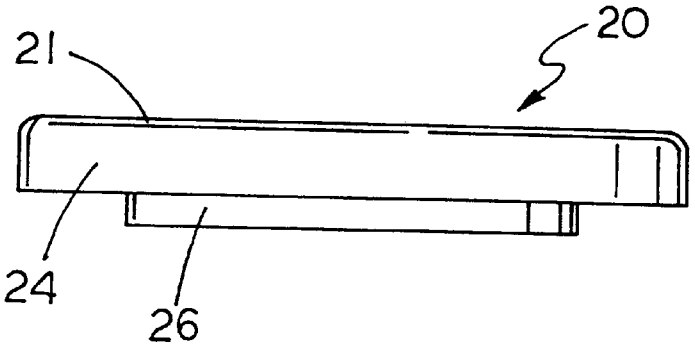
FIG. 2 is a side elevation view of the first embodiment (circular) of the venting plate of this invention.

FIGS. 1–3 show the first embodiment of the venting plate of this invention (designated as reference numeral 20) used on a cylindrical apothecary jar candle 2. As shown, venting plate 20 includes a flat disc shaped body 22 having an upper surface 21, a bottom surface 23, and a circular central exhaust opening or vent 25. Plate body 22 is illustrated as a planar circular disc, but may be conical or domed in shape as desired. Likewise exhaust vent 25 is illustrated as having a circular shape, but may be shaped in any desirable configuration, without deviating from the teachings of this invention. Typically, the diameter of the exhaust vent ranges between 0.5 and 2.0 inches, which is generally ideal for venting exhaust air from the combustion of conventional candle wax.

Plate 20 also includes a peripheral outer flange 24 an inner baffle 26 and three mounting bosses or feet 28. Outer flange 24 extends downward around the periphery of the plate body 22. The outer flange extends downward over brim 14 and provides a decorative covering. As shown, baffle 26 is a vertical skirt, which extends downward from plate body 22 around exhaust vent 25. Baffle 26 follows the contour and shape of outer flange 24 and mirrors the inner contour of brim 14. Feet 28 extend radially between outer flange 24 and baffle 26 at equally spaced locations. As shown, each web 28 has an inclined lower face 29, which slants toward the outer flange 24 and away from the baffle 28.

As shown in FIG. 1, plate 20 sits atop of candle 2 supported by mounting feet 28, such that brim 14 of candle 2 is interposed between outer flange 24 and baffle 26 and the baffle extends downward into mouth 15 of candle 2. Mounting feet 28 support the venting plate atop candle 2 such that bottom surface 23 of body 22 is spaced vertically above the brim and that the brim is interposed at an equal spacing between outer flange 24 and baffle 26. The vertical and horizontal spacing between the venting plate and the vessel brim constitutes an annular inlet vent 27 around the periphery of the mouth through which inlet air can enter candle interior 17. The cross sectional area of inlet vent 27, that is the vertical and horizontal spacing between the venting plate and the vessel brim provides sufficient inlet airflow into the candle interior to maintain efficient combustion. The distance between the venting plate and vessel brims ranges between ⅛ and ⅜ of an inch. The inclined faces 29 of mounting feet 28 act to self-center baffle 26 concentrically within mouth 15 of candle 2. Centering the plate atop candle 2 ensures an unrestricted and concentrically uniform inlet air flow through inlet vent 27 into the candle interior 17.

Operation

FIG. 1 also illustrates how venting cover 20 creates a physically separated concentric laminar air flow within interior 17 of vessel 10, which stabilizes the flame and improves the efficiency of the combustion. As shown, exhaust vent 25 is positioned directly above flame 8. The thermal energy generated from flame 8 creates an upward convection flow of hot exhaust air 7, which exits interior 17 through exhaust vent 25. Positioning the exhaust vent directly above the candle flame focuses the convection draft of exhaust air flow 7 directly upwards, which reduces diffusion of the exhaust flow and its thermal energy. The negative pressure within interior 17 created by exhaust air flow 7 draws an intake air flow 9 of cool ambient air into vessel 10 through inlet vents 27. Baffle 26 directs the inlet air flow 9 downward from the inlet vents 27 along the sidewall 12 of vessel 10 and separates the concentric downward inlet air flow 9 from the upward exhaust air flow 7. The intake air flow circulates concentrically downward along the inside of sidewall 12 and converges toward wick 6 at the base of flame 8. Intake airflow 9 provides the oxidants for the combustion process. The separation of the opposing air flows (inlet and exhaust) reduces turbulence within the interior of the vessel and stabilizes the flame, which leads to a cleaner combustion process and reduced carbon residue (smoke) in the exhaust.

Second Embodiment

Figure 4:
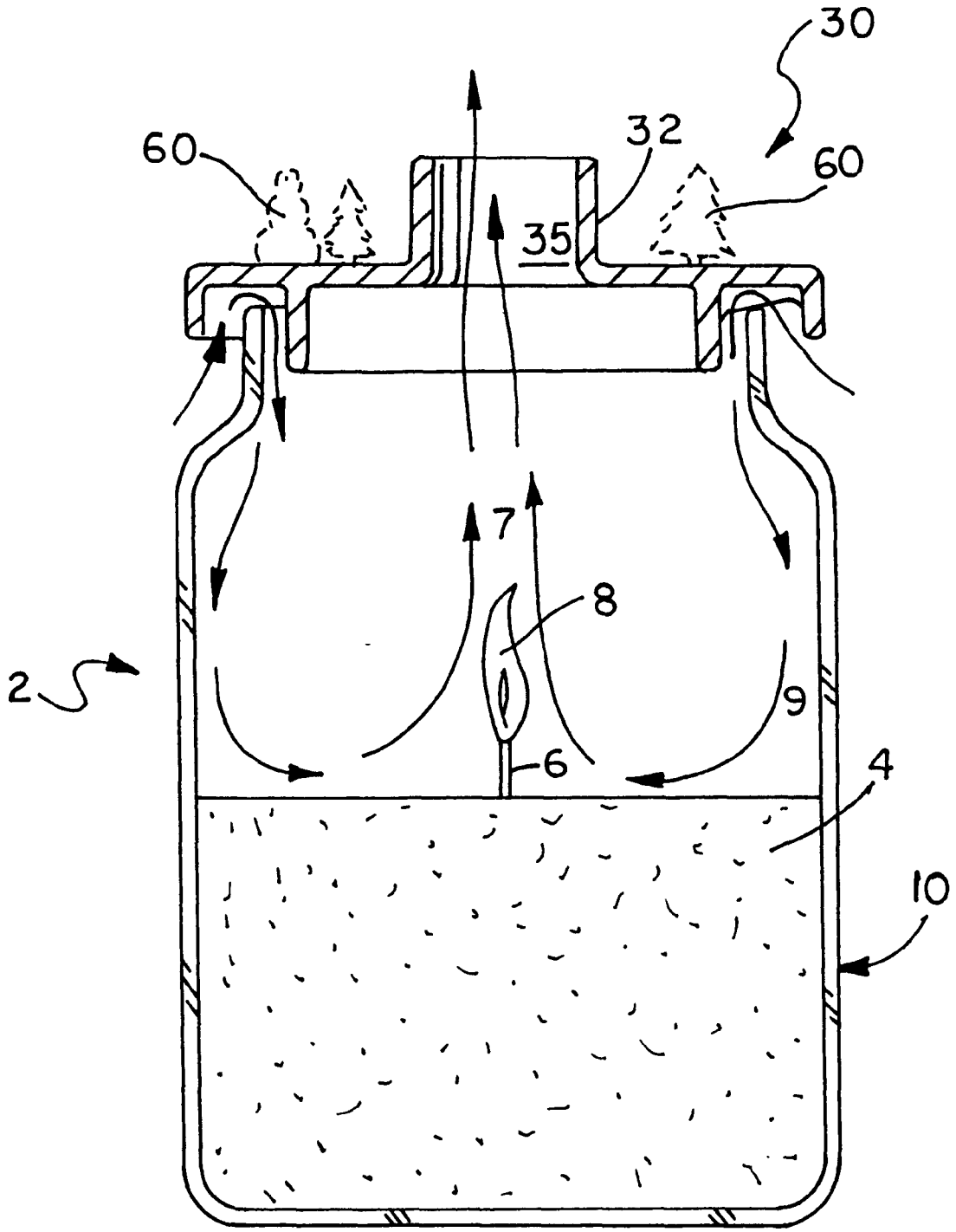
FIG. 4 is a side sectional view of a second embodiment (circular with chimney) of the venting plate of this invention seated atop a cylindrical containerized candle.
Figure 6:
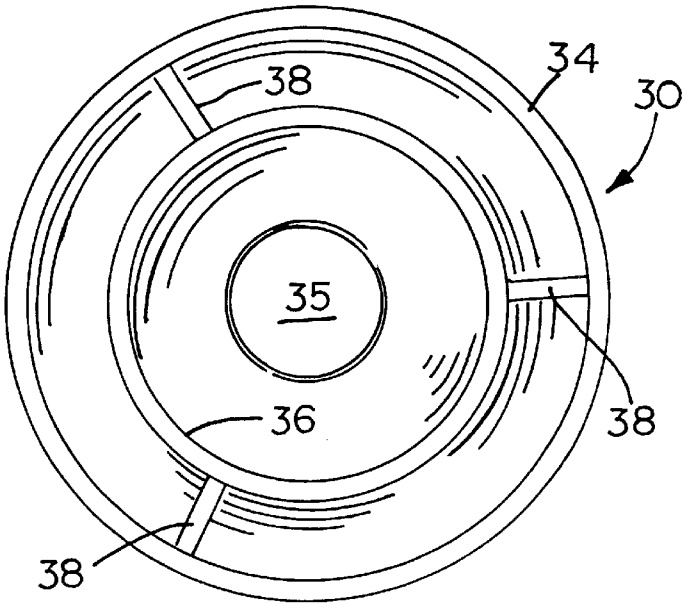
FIG. 6 is a bottom plan view of the second embodiment (circular with chimney) of the venting plate of this invention.
Figure 5:
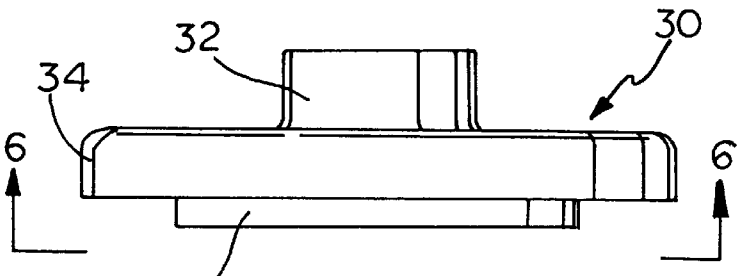
FIG. 5 is a side elevation view of the second embodiment (circular with chimney) of the venting plate of this invention.
Figure 7:
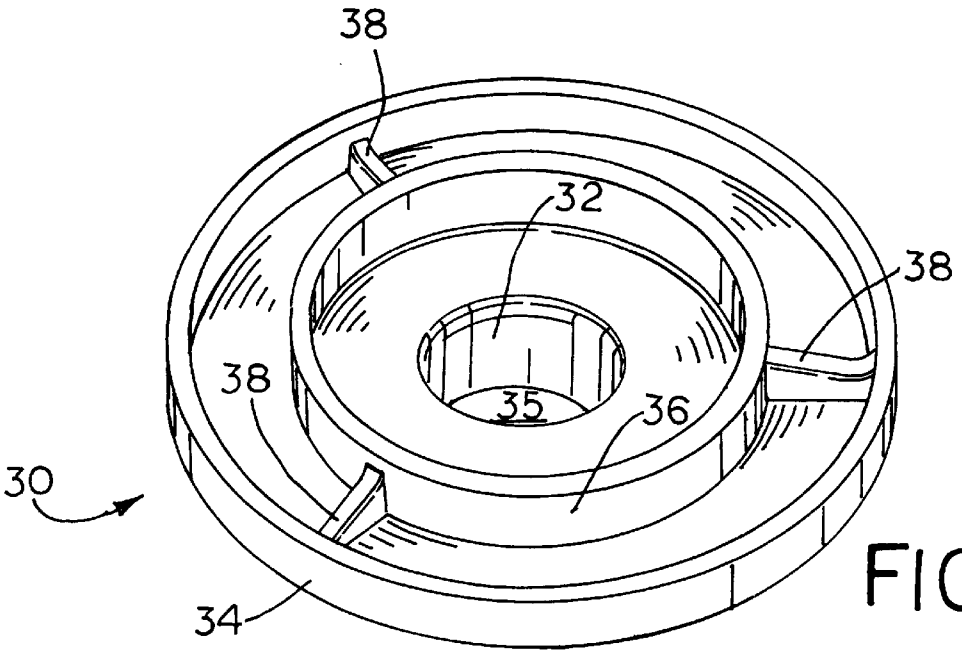
FIG. 7 is a bottom perspective view of the second embodiment (circular with chimney) of the venting plate of this invention.

FIGS. 4–7 show a second embodiment of the venting plate of this invention (designated as reference numeral 30) used with candle 2. Venting plate 30 includes an outer flange 34, a baffle 36 and three mounting feet 38. Venting plate 30 is identical to venting plate 20 of the first embodiment (FIGS. 1–3) except that it includes a tubular chimney 32, which extends upward from the plate body around exhaust vent 35. Chimney 32 provides a thermal shield for decorative figurines and ornamentation that may be mounted to the top surface of the venting plate. As shown in FIG. 4, poly resin and ceramic figurines and ornamentation 60 can adorn the top surface of venting plate 30 for decorative purposes; however, these decorative additions may be damaged by the heat of the hot exhaust air from the candle. Chimney 32 provides a sufficient thermal shield to prevent damage to the ornamentation due to the hot exhaust air venting from the candle.

Third & Fourth Embodiments

Figure 8:
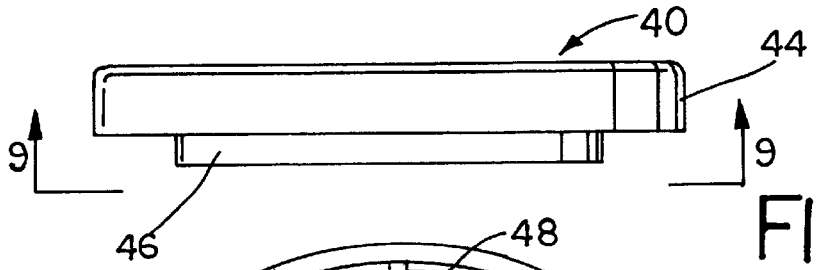
FIG. 8 is a side elevation view of a third embodiment (oval) of the venting plate of this invention.
Figure 9:
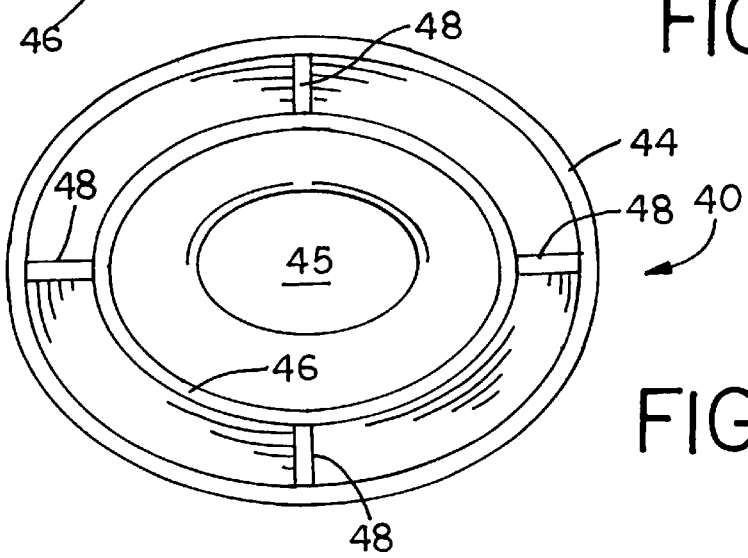
FIG. 9 is a bottom plan view of the third embodiment (oval) of the venting plate of this invention.
Figure 10:
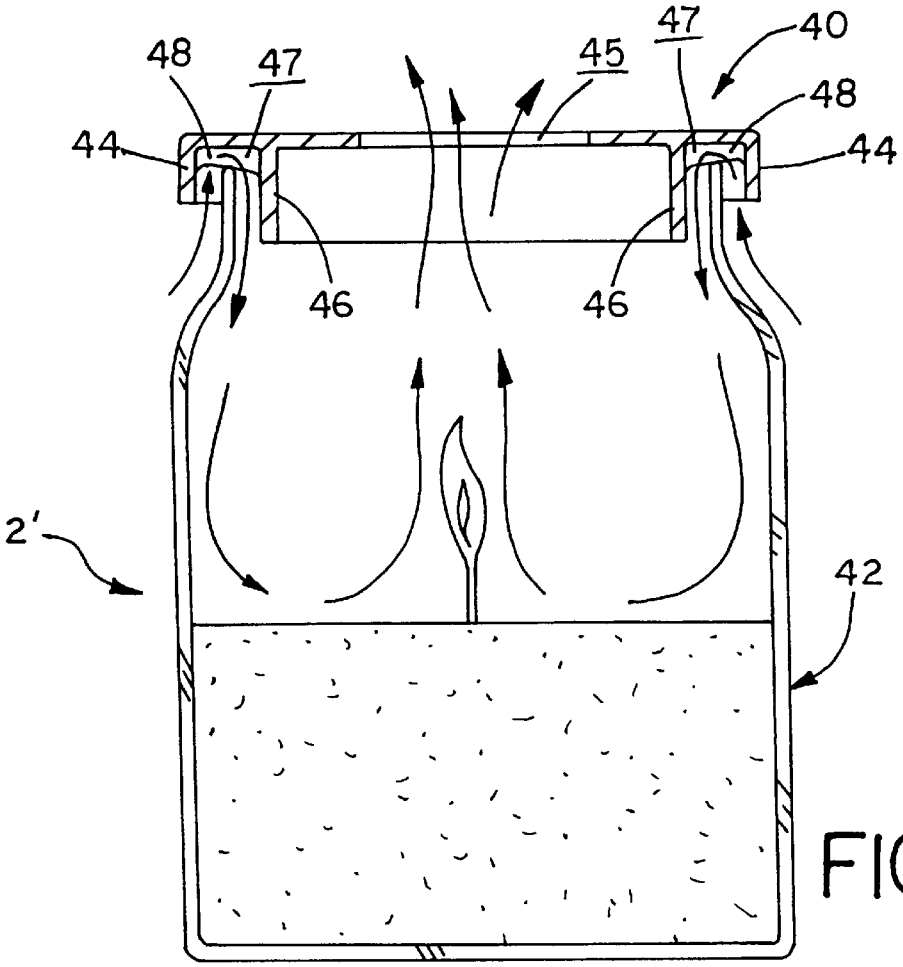
FIG. 10 is a side sectional view of a third embodiment (oval) of the venting plate of this invention seated atop an oval shaped containerized candle.

FIGS. 8–10 illustrate a third oval embodiment of the venting plate of this invention (designated as reference numeral 40) used with an oval containerized candle 2'. The construction of venting plate 40 is identical to venting plate 20 of the first embodiment, except in shape. Likewise, candle 2' is identical to candle 2 except for the oval shape of the vessel 42. As show, the body of plate 40 is oval and has an oval shaped exhaust vent 45. Venting plate 40 includes an outer flange 44, a baffle 46, four mounting feet 48, which support the venting plate to form an oval peripheral inlet vent 47.

FIGS. 11–13 illustrate a fourth square embodiment of the venting plate of this invention (designated as reference numeral 50) used on a rectangular two-wicked containerized candle 2". Again, venting plate 50 is basically identical to venting plate and candle 2 of the first embodiment, except in shape. As shown, candle 2" includes a square vessel 52 but also includes two wicks 6. Venting plate 50 includes an outer flange 54, a baffle 56, four mounting feet 58, which support the venting plate to form square peripheral inlet vent 57. Venting plate 50 has two exhaust vents 55, which are positioned directly over two wicks 6 of candle 2". Again, baffle 56 is a vertical skirt that extends downward around both exhaust vents and follows the square contour of the brim of vessel 52. Although, not necessary for efficient operation, venting plates used with multiple wicked containerized candles will have a separate exhaust vent situated directly above each individual wick. While the exhaust air flow will naturally draft through a single exhaust vent in the plate, providing multiple exhaust vents for multiple wicks, reduces exhaust draft mixing and turbulence within the candle interior. These last two embodiments illustrate that the venting plate of this invention can be adapted for uses with containerized candles of varying shapes and dimensions, as well as, with various multi-wicked containerized candles.

Advantages

One skilled in the art will note several advantages of the venting plates of this invention over the venting plates of U.S. patent application Ser. No. 09/925,893. Principally, the venting plate of this invention can be configured to be used with any containerized candle regardless of shape, wick configuration or dimension. The use of an internal baffle to direct the inlet air flow concentrically along the sidewalls of the containerized candle ensures concentric laminar air flow within the containerized candle and separation of the inlet and exhaust air flows. The physical separation of the inlet and exhaust air flow openings is sufficient to maintain laminar flow within the containerized candle regardless of the shape or dimension of the vessel interior.

The inlet vent design of the venting plates of this invention also provides significant functional and esthetic advantages. Forming the inlet vents by spacing the body of the venting plate above the vessel rim eliminates the need for additional inlet vent openings in the body of the plate. Functionally, eliminating the inlet openings in the venting plate body and forming inlet vents beneath the plate ensures that the inlet air is drawn into the vessel interior as distant from the exhaust air flow as possible, thereby maximizing flow separation. Esthetically, since only an exhaust vent opening is required, the upper surface of the plate around the exhaust vent can be adorned with decorative figurines and ornamentation without affecting it functionally. It should be noted that such adornments may be protected from thermal damages by incorporating the chimney feature of the second embodiment as needed.

The self centering feature provided by the inclined face of the mounting feet ensures that the venting plate is properly seated atop the containerized candle and that the spacing of the inlet vent is unrestricted and uniform around the periphery of the vessel brim, which promotes stable combustion even for multiple wick configurations. The outer flange provides a decorative cover for the mounting feet and inlet vent for a pleasing esthetic appearance.

One skilled in the art will also note that the venting plates of this invention can accommodate containerized candles with multiple wicks. The venting plate may incorporated multiple exhaust vents without affecting the flow separation needed for concentric laminar airflow within the containerized candle. While an exhaust vent is ideally situated directly over a wick, convection exhaust drafts will be draw upward though any exhaust vent in close proximity, so that a single exhaust vent may accommodate the exhaust air flow from several burning wicks.

The venting cover of this invention when used properly with a containerized candle also presents no fire or safety hazards. Although the venting cover may be constructed of metal, which is generally a good conductor of thermal energy, the operation of the venting cover generally ensures that the venting cover does not becomes too hot to touch. Consequently, the venting cover never becomes hot to the touch and is therefore not a safety hazard. As long as the hand is not placed directly over the hot exhaust coming through the exhaust vent, the venting cover can be removed by hand during use without injury.

It is understood that the above description does not limit the invention to the details given, but may be modified within the scope of the following claims.

I claim:

1. A venting apparatus (20) for improving the stability and efficiency of the combustion flame of a containerized candle that includes a fuel source burnt in the flame, a wick and a vessel having sidewalls that terminate in brim, which defines an interior thereof for enclosing the wick and fuel source and an open mouth, the venting apparatus comprising:

a flat body (22) shaped and dimensioned to cover the open mouth (15) of the vessel (10), the body having a flat top surface upon which ornamentation can be mounted, and a flat bottom surface, the body also having an opening (20) therein and located to directly overlie the flame of the containerized candle when the cover is seated atop the candle vessel and the containerized candle burns for venting exhaust air from the flame;

a plurality of feet (28) extending downward from the bottom surface of the body to support and space the bottom surface of the body from and over the vessel brim when the venting apparatus is seated atop the candle for venting inlet air into the interior of the vessel over the vessel brim between the vessel brim and bottom surface of the body, each of the plurality of feet has an inclined bottom face, which is in abutting engagement with the brim of the vessel when the venting apparatus is seated atop the candle; and a baffle (26) extending downward from the bottom surface of the body and shaped to follow the peripheral contour or the mouth of the vessel, to be spaced laterally from the sidewalls of the vessel, and to extend partially into the mouth of the vessel when the venting apparatus is seated atop the vessel for re-directing air flow venting into the vessel interior between the brim and bottom surface of the body through the inlet vent means downward as a curtain of inlet air along the sidewalls of the vessel and for separating the inlet air from the exhaust air.

2. The combination of claim 1 wherein the inclined bottom face of each of the plurality of feet constituting means for centering the baffle within the mouth of the vessel when the venting apparatus is seated atop the candle.

3. In combination, a jar candle and a venting apparatus (20) for improving the stability and efficiency of the combustion flame of the containerized candle, the jar candle includes:

a vessel having sidewalls defining an interior thereof and an upper brim defining an open mouth thereof; a fuel source disposed within the vessel interior for burning by the flame; and at least one wick disposed within the fuel source, the venting apparatus includes:

a flat body (22) shaped and dimensioned to cover the open mouth (15) of the vessel (10), the body having a flat top surface upon which ornamentation can be mounted, and a flat bottom surface, the body also having an opening (20) therein and located to directly overlie the flame of the containerized candle when the cover is seated atop the candle vessel and the containerized candle burns for venting exhaust air from the flame;

a plurality of feet (28) extending downward from the bottom surface of the body to support and space the bottom surface of the body from and over the vessel brim when the venting apparatus is seated atop the candle for venting inlet air into the interior of the vessel over the vessel brim between the vessel brim and bottom surface of the body, each of the plurality of feet has an inclined bottom face, which is in abutting engagement with the brim of the vessel when the venting apparatus is seated atop the candle; and a baffle (26) extending downward from the bottom surface of the body and shaped to follow the peripheral contour or the mouth of the vessel, to be spaced laterally from the sidewalls of the vessel, and to extend partially into the mouth of the vessel when the venting apparatus is seated atop the vessel for re-directing air flow venting into the vessel interior between the brim and bottom surface of the body through the inlet vent means downward as a curtain of inlet air along the sidewalls of the vessel and for separating the inlet air from the exhaust air.

4. The combination of claim 3, wherein the inclined bottom face of each of the plurality of feet constituting means for centering the baffle within the mouth of the vessel when the venting apparatus is seated atop the candle.

* * * * *